US009721485B2

(12) United States Patent
Soares

(10) Patent No.: US 9,721,485 B2
(45) Date of Patent: Aug. 1, 2017

(54) FREIGHT REMOVAL REGULATION APPARATUS

(71) Applicant: Toyota Motor Engineering & Manufacturing North America, Inc., Troy, MI (US)

(72) Inventor: Christopher J Soares, Cambridge (CA)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 382 days.

(21) Appl. No.: 14/165,736

(22) Filed: Jan. 28, 2014

(65) Prior Publication Data

US 2015/0208804 A1 Jul. 30, 2015

(51) Int. Cl.
*B66F 17/00* (2006.01)
*G09F 7/20* (2006.01)

(52) U.S. Cl.
CPC ..... *G09F 7/20* (2013.01); *B66F 17/003* (2013.01)

(58) Field of Classification Search
CPC ..... B66F 17/003; G09F 7/20
USPC ..... 410/69, 70, 77, 80, 94, 121; 49/50, 55; 211/180, 186, 195
See application file for complete search history.

(56) References Cited

U.S. PATENT DOCUMENTS 5,839,864 A * 11/1998 Reynard ..... B60P 7/13 410/69
6,499,254 B2 12/2002 Rossman et al.
2011/0068943 A1 3/2011 Lane, Jr.

OTHER PUBLICATIONS

Cisco-Eagle, "High Pallet Safety Gate—Open Top, 60"W × 62"D" Essex, MA. printed 2014 from http://www.cisco-eagle.com/catalog/p-166652-high-pallet-safety-gate-open-top-60w-x-62d.aspx.
Mezzbarriers, "Edge Protection for Your Workforce—Pallet Gates and Safety Barriers", Manchester, United Kingdom, printed 2014 from http://www.mezzbarriers.co.uk/MezzBarriers_Pallet_Gates_Brochure.pdf.

* cited by examiner

*Primary Examiner* — Stephen Gordon
(74) *Attorney, Agent, or Firm* — Christopher G. Darrow; Darrow Mustafa PC

(57) ABSTRACT

A method and apparatus to regulate the use and removal of freight. The apparatus includes a sensing element, a stoppage element, and at least one actuator. The sensing element is operable to determine the presence of freight. Stoppage element can alternate between a first condition configured to impede freight removal and a second condition configured to permit freight removal. The presence of freight maintains stoppage element in the first condition absent engagement of the at least one actuator and engagement of the at least one actuator switches stoppage element to the second condition when freight is present.

16 Claims, 8 Drawing Sheets

FREIGHT REMOVAL REGULATION APPARATUS

BACKGROUND

The present disclosure relates to an apparatus for increasing worker safety and improving industrial efficiency and, in particular, an apparatus for preventing freight from being prematurely removed from a work station.

When freight, such as bulk loads of parts, subassemblies, and other articles is transported to and from various workstations within an industrial setting, it is often necessary to have an accurate system for signaling when such freight may be removed. For example, in an assembly plant, a large rack loaded with parts for subassembly may be deposited by forklift at the appropriate workstation where workers will take the parts from the rack for subassembly. A forklift may then subsequently remove the rack, but should only do so when all parts have been removed and when no worker is reaching into the rack. Removal of the rack while parts remain stowed will decrease process efficiency, and removal of the rack while workers are accessing it may compromise worker safety.

Various imperfectly reliable signaling procedures, such as requiring workers to manually hang a sign indicating when freight should or should not be removed, have been employed. Such systems can fail when a worker forgets to follow the procedure or when the signal is insufficiently visible.

A system which automatically blocked freight removal when workers are accessing the freight and/or while articles remain stowed in the freight would improve efficiency and safety. A system which additionally provided convenient means for a worker to enable freight removal at the appropriate time while simultaneously warning other workers away would improve efficiency and safety further still.

SUMMARY

A freight removal regulation apparatus includes a sensing element operable to determine the presence of freight, a stoppage element operable to alternate between a first condition configured to impede freight removal and a second condition configured to permit freight removal, and an actuator. The presence of freight maintains the stoppage element in the first condition absent engagement of the actuator and engagement of the actuator switches the stoppage element to the second condition when freight is present.

A freight use regulation apparatus includes a sensing element operable to determine the presence of freight, a warning element configured to alternate between a first state allowing user access and a second state warning against user access, and an actuator. The presence of freight maintains the warning element in the first state absent engagement of the actuator and engagement of the actuator switches the warning element to the second state when freight is present.

A method to improve freight use comprises placing freight in with respect to a sensing element causing a stoppage element to be present in a first condition configured to impede freight removal and engaging an actuator to switch the stoppage element to a second condition configured to permit freight removal.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

The apparatus of the present disclosure can be better understood with reference to FIGS. 1-5 showing one non-limiting variation of the apparatus. It is to be understood, and will be readily apparent to one skilled in the art, that the variation illustrated in FIGS. 1-5 is exemplary in nature and is not intended to imply any limitation to the particular details of configuration or operation shown.

Figure 1:
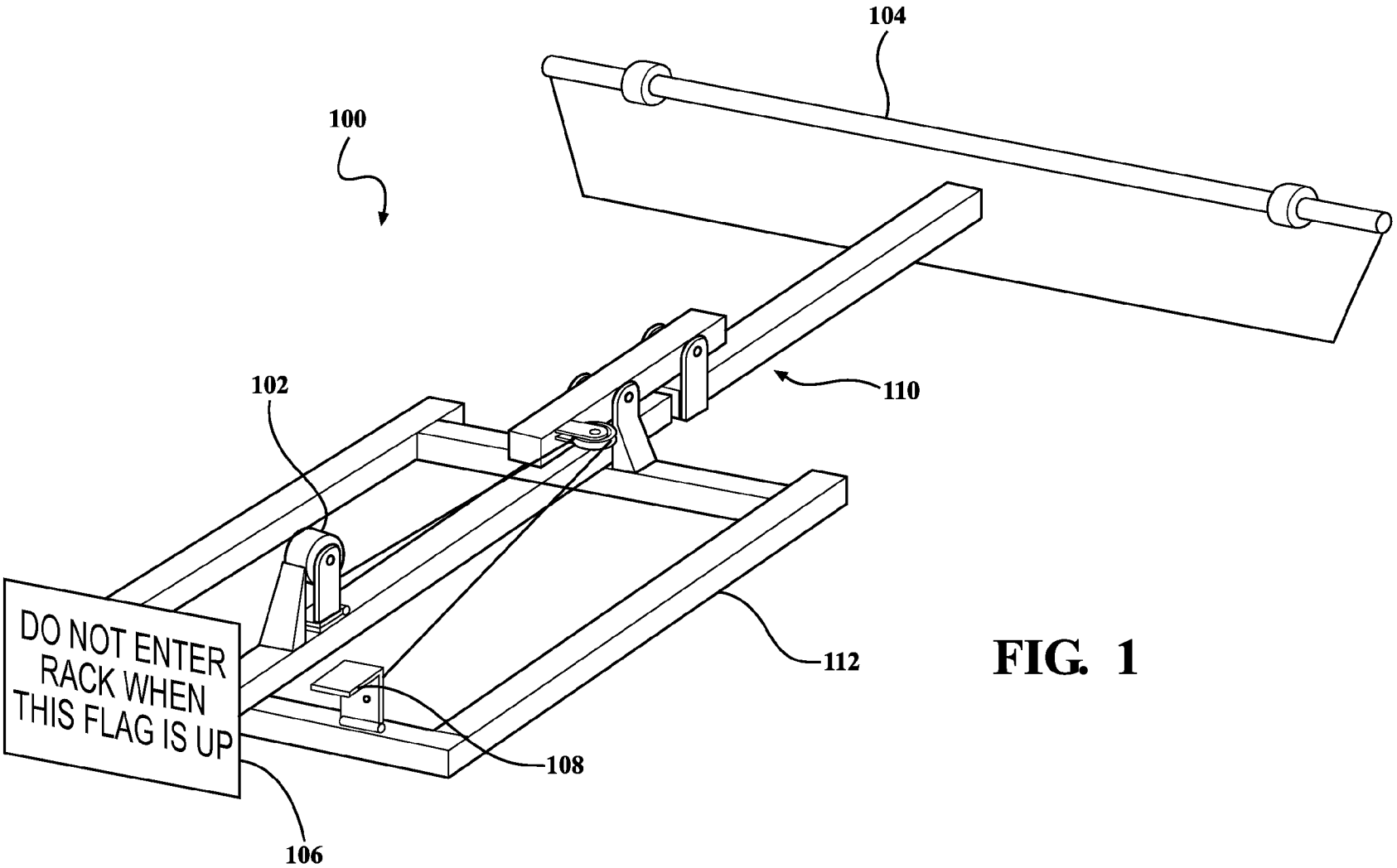
FIG. 1 is a perspective view of a freight removal regulation apparatus according to the present disclosure.

FIG. 1 illustrates an example of a freight removal regulation apparatus 100 according to the disclosed principles. The apparatus 100 includes a sensing element 102 operable to detect the presence of freight. The apparatus 100 also includes a stoppage element 104 operable to alternate between at least two conditions. One such condition can be effective to impede removal of freight while another such condition is not effective to impede removal of freight. These two conditions will be referred to herein as the first condition and the second condition, respectively.

The apparatus additionally includes a warning element 106 operable to alternate between at least two states. One such state will not issue a warning to avoid accessing freight while another such state can be effective to warn a user against accessing freight. These two states will be referred to herein as the first state and the second state, respectively. The apparatus further includes an actuator 108 which can be effective in certain circumstances, when engaged, to switch stoppage element from the first condition to the second condition and to switch warning element from the first state to the second state.

The particular variation of the apparatus shown in FIG. 1 also includes a compound effector arm 110 to which the sensing element 102, stoppage element 104, and warning element 106 are attached. The effector arm 110 in this variation is pivotably attached to support base 112.

In general, when freight is present and actuator 108 has not been engaged, stoppage element 104 will be present in the first condition wherein it impedes freight removal and warning element 106 will be present in the first state wherein it does not issue a warning against, or will permit, user access to freight. Subsequent engagement of actuator 108 can then cause stoppage element 104 to switch to the second condition wherein it does not impede freight removal and warning element 106 to switch to the second state wherein it is effective to warn a user against accessing freight.

Figure 2:
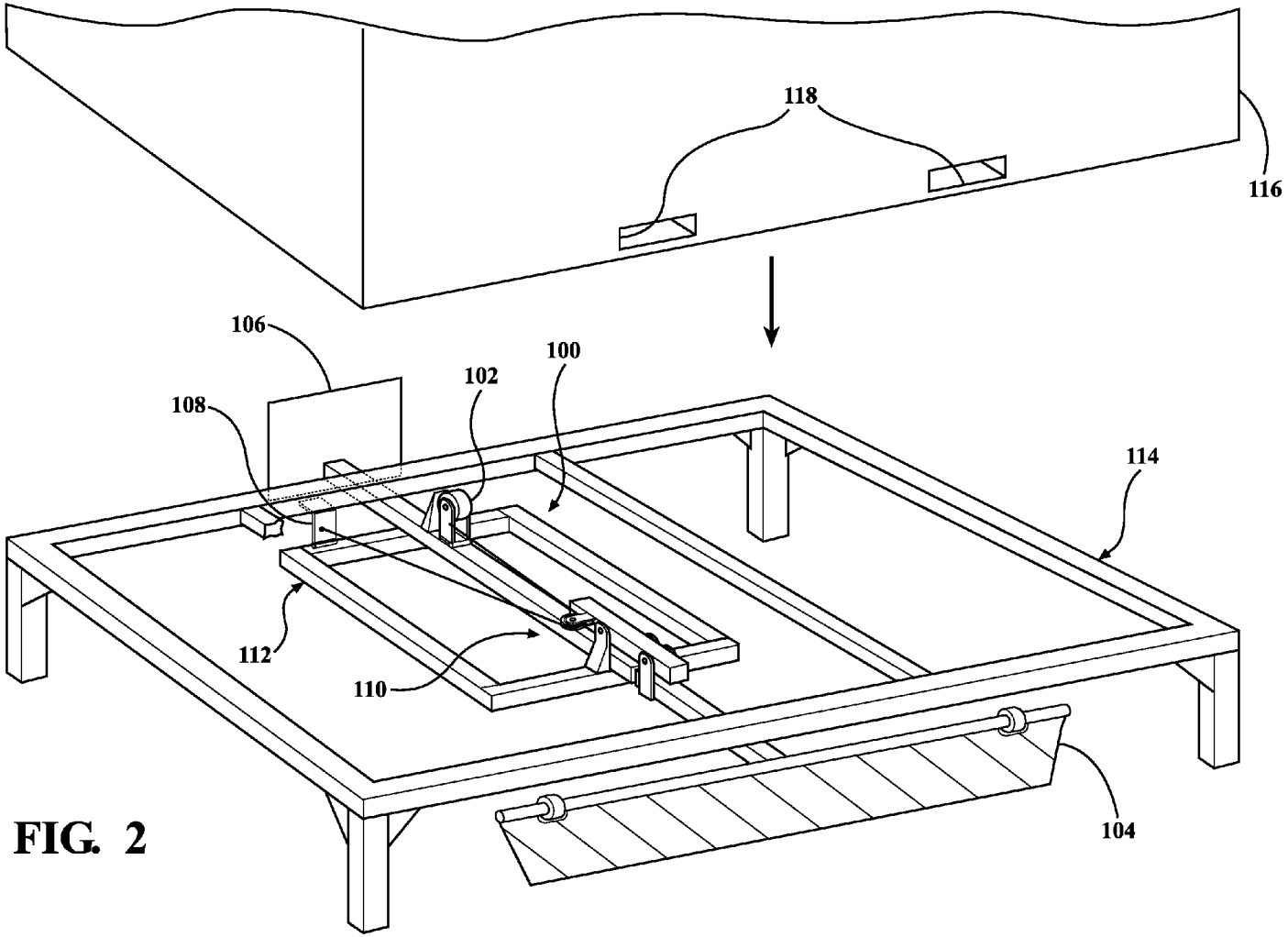
FIG. 2 is a perspective view of freight removal regulation apparatus of FIG. 1 directed toward a stoppage element and with freight not present.

FIG. 2 shows the apparatus 100 in conjunction with an optional freight support structure 114 operable to support freight 116. In the example of FIG. 2 freight 116 is a pallet style rack capable of containing articles. Freight 116 additionally comprises lift access means 118. In this particular example lift access means 118 comprise a pair of fork engagement ports, suitable to receive the prongs of a forklift fork pursuant to freight transport.

Figure 3A:
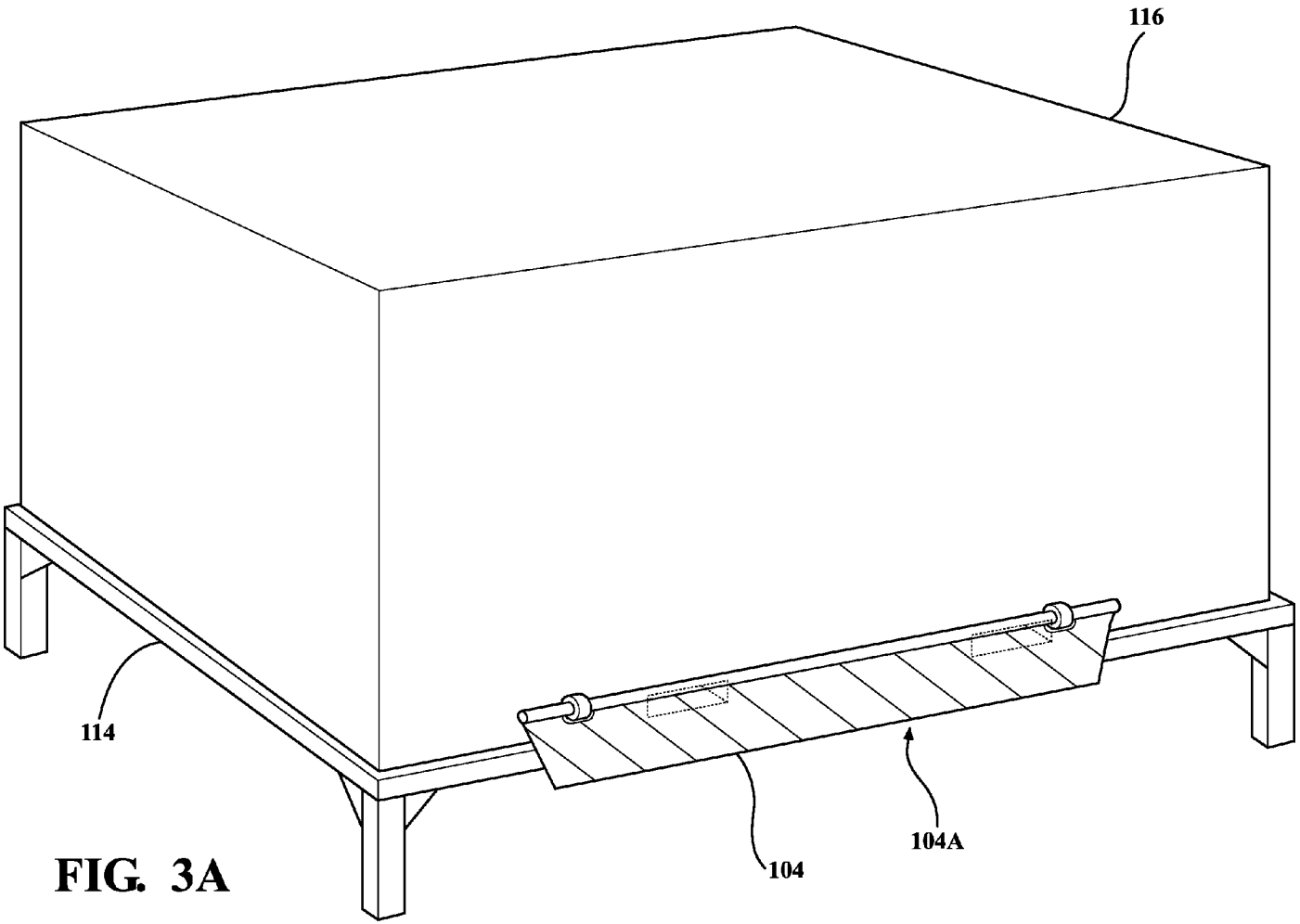
FIG. 3A is a perspective view of freight removal regulation apparatus of FIGS. 1 and 2 and with stoppage element present in a first condition due to presence of freight.
Figure 3B:
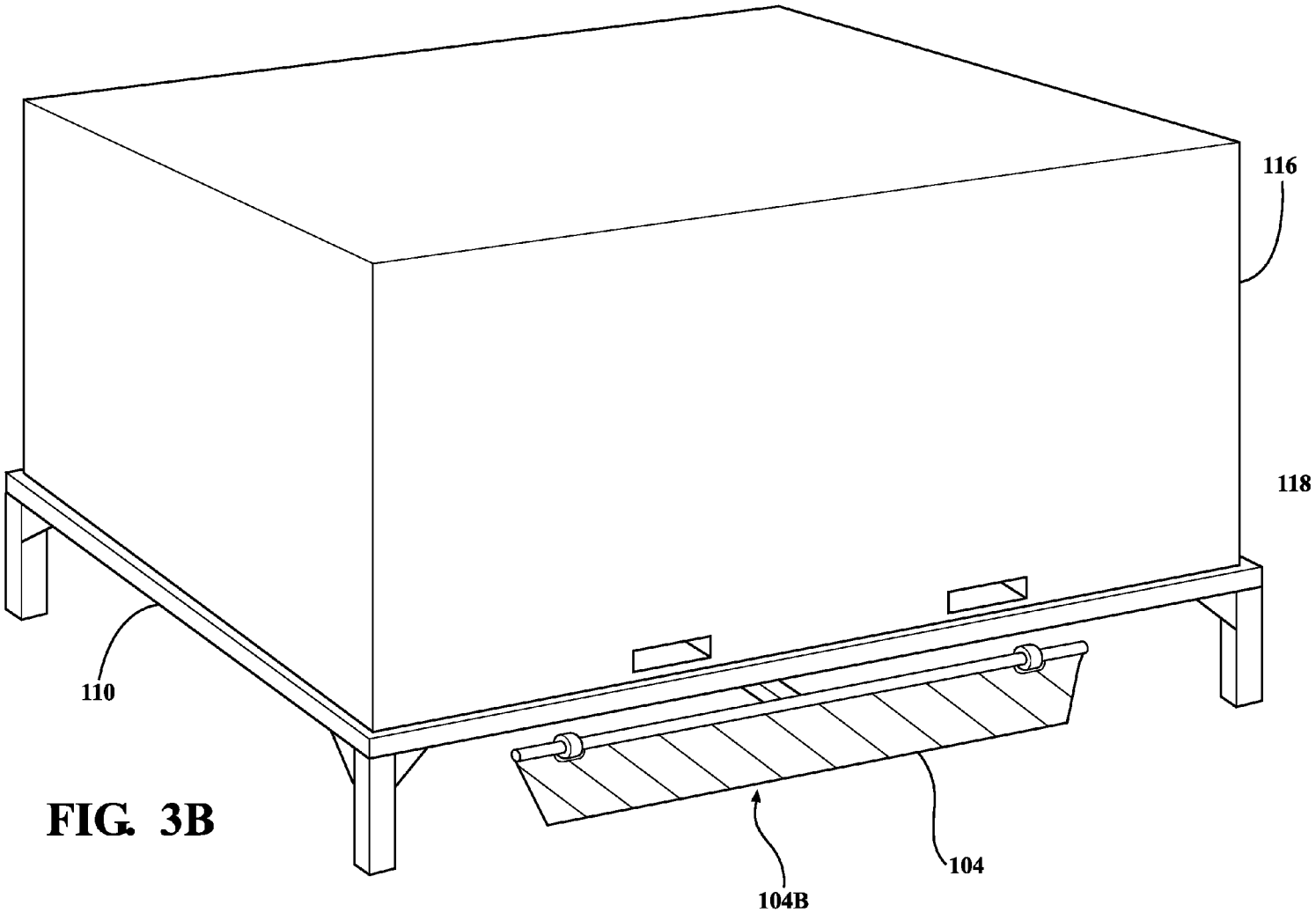
FIG. 3B is a perspective view of freight removal regulation apparatus of FIGS. 1 and 2 and with stoppage element present in a second condition due to engagement of an actuator.

Turning now to FIGS. 3A and 3B, the apparatus 100 is shown with freight support structure 114 and with freight 116 present. In FIG. 3A, freight 116 is present while actuator 108 has not been engaged. Therefore stoppage element 104 is present in a first condition 104A wherein stoppage element 104 obstructs lift access means 118. In FIG. 3B freight 116 is present and actuator 108 has been engaged. Therefore stoppage element 104 is present in a second condition 104B. In the second condition 104B, stoppage element 104 does not obstruct lift access means 118, thereby enabling removal of freight 116.

Figure 4A:
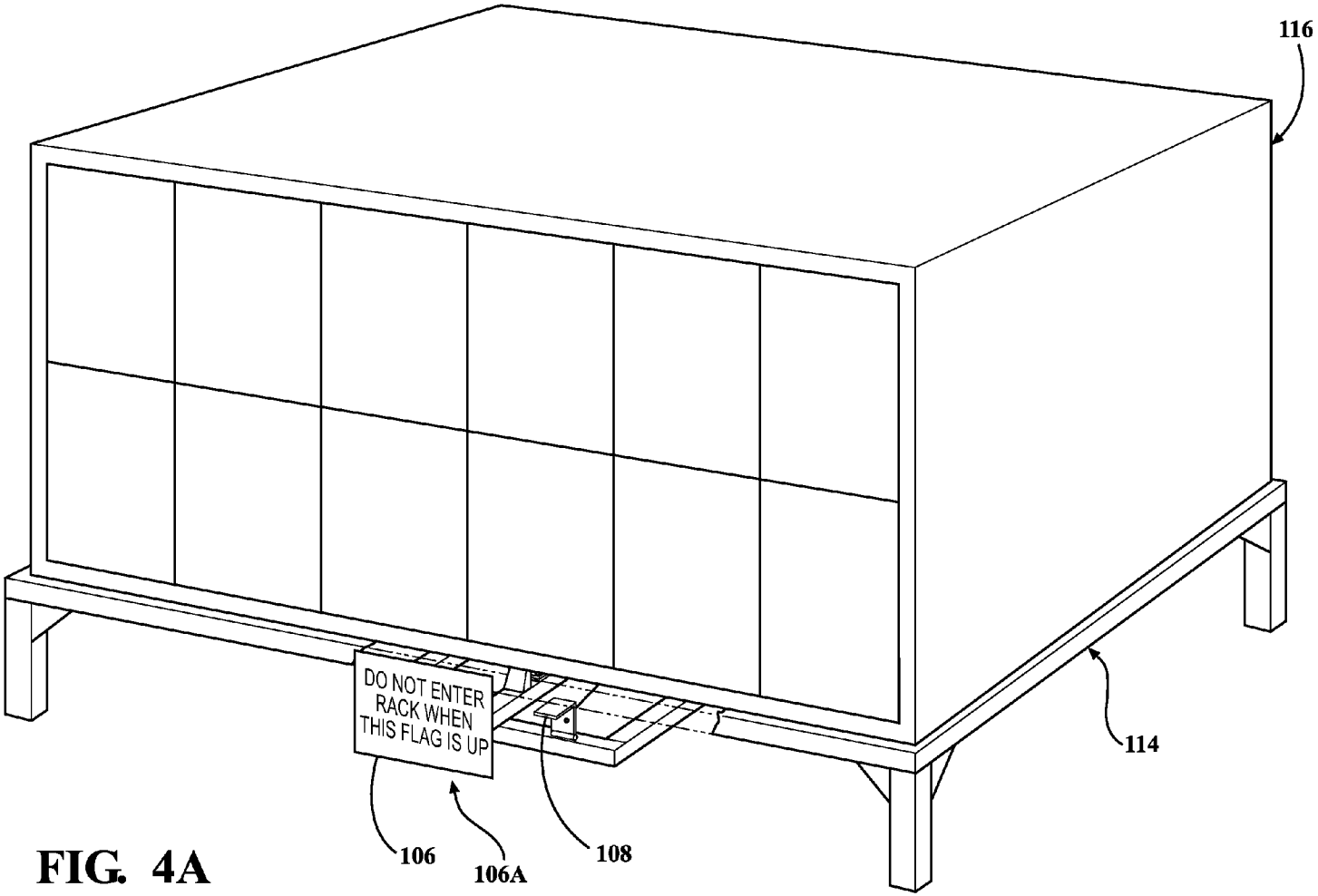
FIG. 4A is a perspective view of freight removal regulation apparatus of FIG. 1 directed toward a warning element present in a first state due to presence of freight.
Figure 4B:
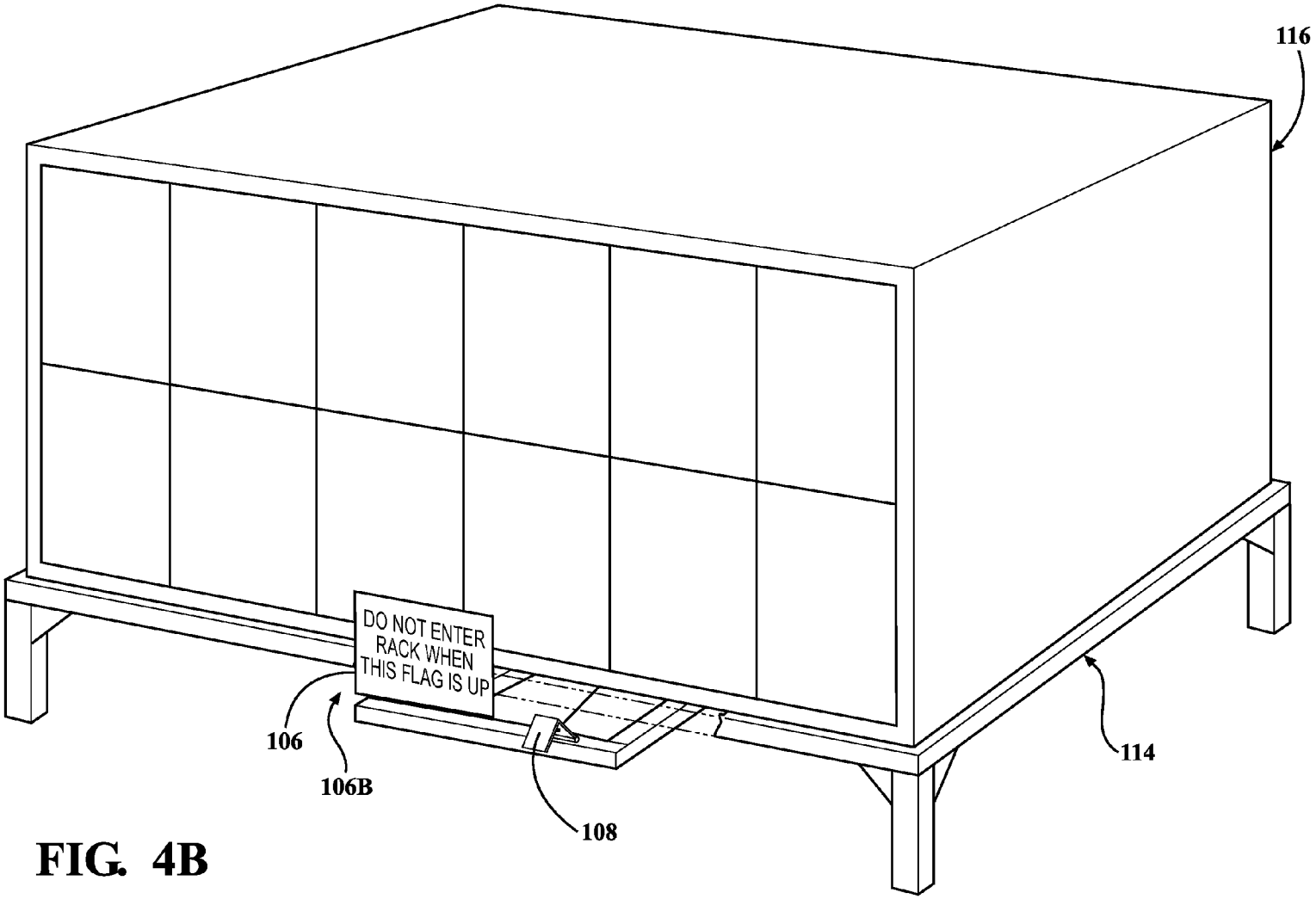
FIG. 4B is a perspective view of freight removal regulation apparatus of FIG. 4A with warning element present in a second state due to engagement of an actuator.

FIGS. 4A and 4B show similar perspective views of the apparatus 100 with freight support structure 114 and freight 116, but from a vantage point that is directed primarily to warning element 106 and actuator 108. In FIG. 4A, freight 116 is present while actuator 108 has not been engaged. Therefore warning element 106 is present in a first state 106A wherein it allows user access or does not warn a user to avoid accessing freight 116 contents. In FIG. 4B, freight 116 is present and actuator 108 has been engaged. Therefore warning element 106 has switched to a second state 106B wherein it is operable to warn against user access to freight 116 contents, such as various articles that may be stowed in a pallet style rack.

With particular reference then to FIGS. 3 and 4, when freight 116 is present and actuator 106 has not been engaged, stoppage element 104 is present in the first condition 104A wherein it impedes removal of freight 116 and warning element 106 is present in the first state 106A wherein it allows a user to access freight 116. Once actuator 108 is engaged stoppage element 104 switches to the second condition 104B wherein it does not impede freight removal and warning element 106 switches to the second state 106B wherein it is effective to warn against user access.

This arrangement can confer benefits to both user safety and efficiency of freight utilization. In particular, it minimizes the likelihood that freight 116 will be engaged by a lifting apparatus and/or removed either while a user is accessing freight 116 contents or while useful contents remain in freight 116. Only after a user engages actuator 108, likely because all useful contents have been taken, can freight 116 be removed. And once freight removal is enabled by engagement of actuator 108, all users are warned to avoid access.

Figure 5A:
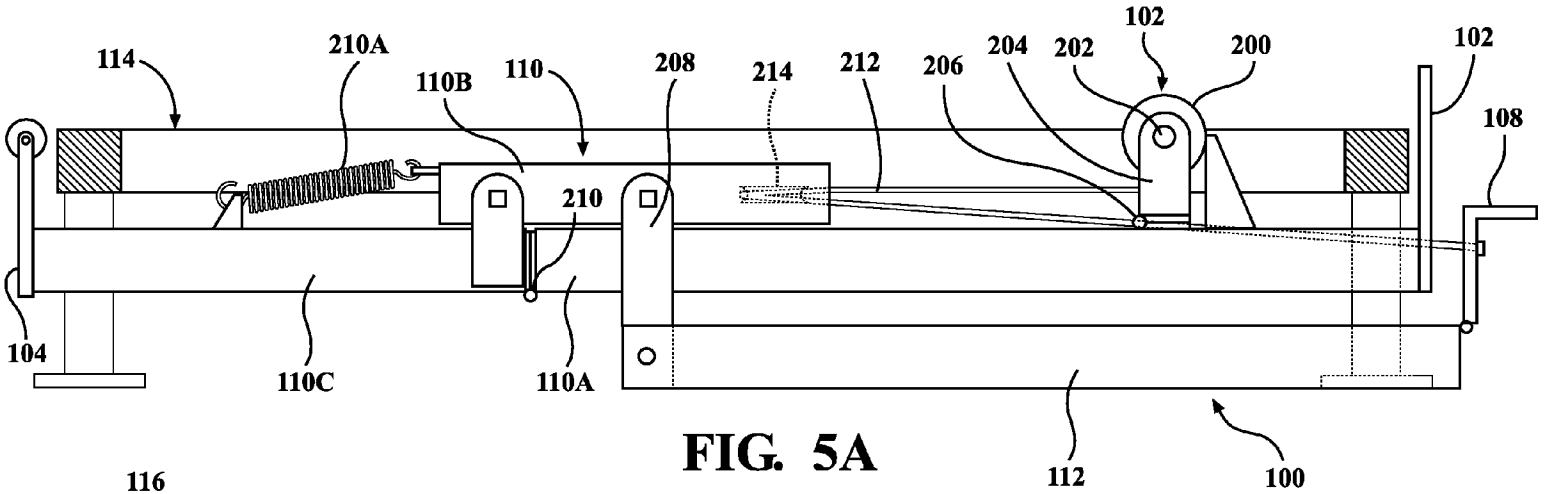
FIG. 5A is a side cross-sectional view of freight removal apparatus of FIG. 1 with freight not present.
Figure 5B:
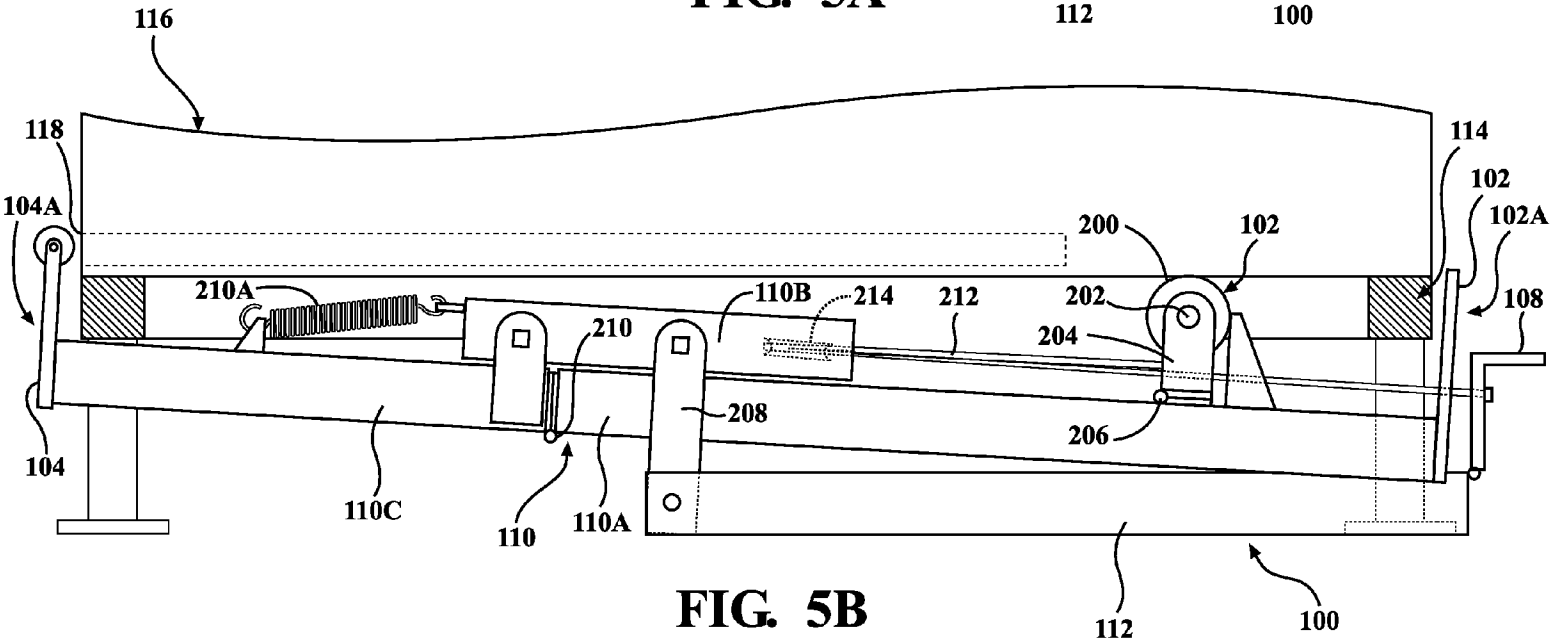
FIG. 5B is a side cross-sectional view of freight removal apparatus of FIG. 1 with stoppage element in a first condition and warning element in a first state due to presence of freight.
Figure 5C:
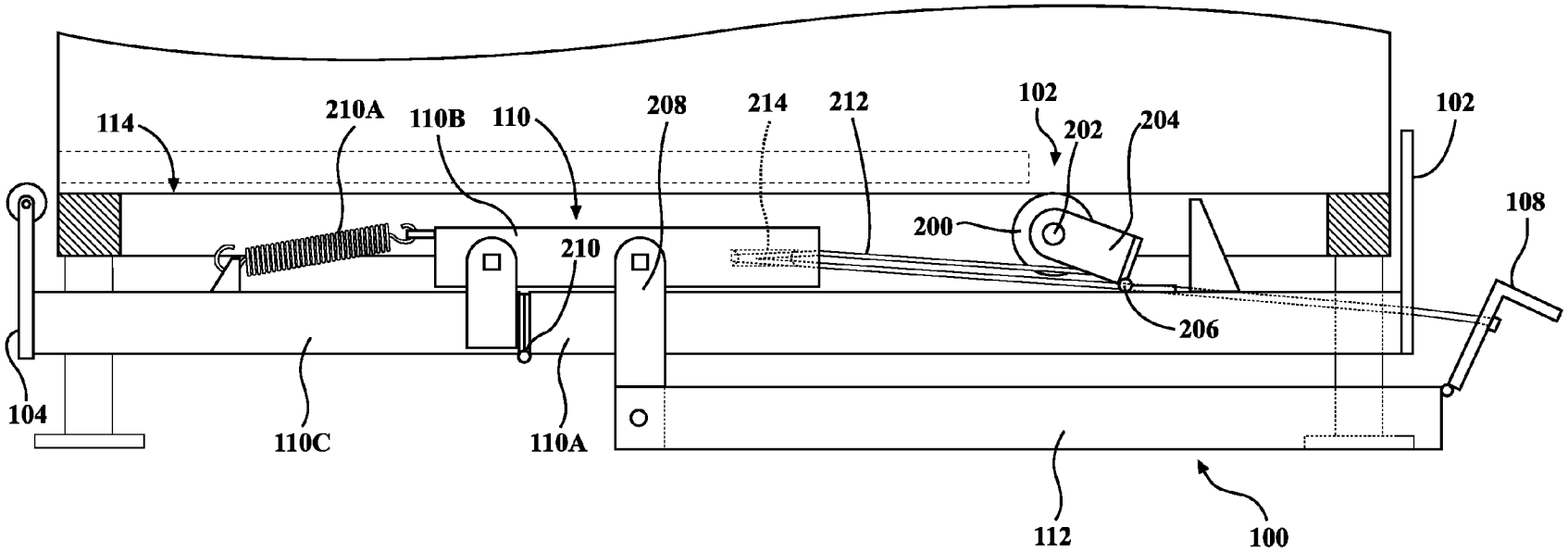
FIG. 5C is a side cross-sectional view of freight removal apparatus of FIG. 1 with stoppage element in a second condition and warning element in a second state due to engagement of an actuator.

Turning now to FIGS. 5A-C, a series of side cross-sectional views illustrate the specific operational details of the particular variation of the apparatus detailed above and in FIGS. 1-4. Referring first to FIG. 5A showing the apparatus 100 with a freight support structure 114, the sensing element 102 comprises a wheel 200, rotatable on axle 202, disposed within mounting arm 204. Mounting arm 204 is pivotably attached to effector arm 110 via a resiliently pivotable joint 206 such that mounting arm 204 tends to resiliently maintain orthogonality relative to effector arm 110. Additionally actuator 108 is in mechanical communication with sensing element 102 via tether 212 supported on pulley 214 which is disposed on effector arm 110.

Effector arm 110 is pivotably attached via bracket 208 to support base 112. In this particular example, effector arm 110 includes an optional damage avoidance mechanism wherein effector arm 110 is a compound arm comprising parallel beams 110A, 110B, and 110C. Beam 110A is attached to beam 110B via pivotable joint 210, made resilient by spring 210A. This allows effector arm 110 to reversibly break or flex during an interval when freight 116 is being placed on freight support structure 114 and freight lift means such as a forklift are in contact with stoppage element 104.

FIG. 5B presents a view similar to that of FIG. 5A but wherein freight 116 is present on freight support structure 114. When present, freight 116 contacts wheel 200, displacing sensing element 102 and causing effector arm 110 to pivot as shown. Pivoting of effector arm 110 causes stoppage element 104 to adopt, within the frame of reference of FIG. 4B, an elevated position and causes warning element 106 to adopt, again within the frame of reference of FIG. 4B, a lowered position. The elevated position of stoppage element 104 is the first condition 104A wherein it obstructs lift access means 118 and the lowered position of warning element 106 is the first state 106A in which it allows, or does not warn against, user access.

Comparison of FIG. 5B to FIG. 5C illustrates the mechanism by which engagement of actuator 108 causes stoppage element 104 to switch to the second condition 104B and warning element 106 to switch to the second state 106B. In this example, actuator 108 is a foot pedal which, when depressed, pulls tether 212 about pulley 214 such that tether 212 exerts a force on mounting arm 204. The force exerted by tether 212 rotates mounting arm 204 about resiliently pivotable joint 206 decreasing downward force exerted by freight 116 on sensing element 102. This allows effector arm 110 to pivot back to its original orientation wherein stoppage element 104 is in a lowered, second condition 104B and warning element 106 is in an elevated, second state 106B.

It is to be understood that the specific configurational details shown in FIGS. 1-5 are for illustrative purposes only, and not intended to be limiting. For example, freight 116 in the example discussed is a pallet style rack. In various alternative configurations, freight 116 can include a standard pallet, skid, barrel, or any other implement suitable for holding articles during storage or transport.

Similarly lift access means 118 in the example discussed comprise a pair of fork engagement ports. Lift access means 118 can additionally or alternatively include one or more hooks, rings, hasps, staples, rims, or any other structures or features operable to be engaged by a lift or removal device. Correspondingly the apparatus 100 can be employed in conjunction with a variety of different freight lift or removal devices. Non-limiting examples of freight lift or removal devices in conjunction with which the apparatus can be employed include a forklift, a crane equipped with a hook, drum grab, or any other implement or device suitable to lift and/or remove freight.

While the example sensing element 102 discussed above is purely mechanical in operation, the sensing element 102 can additionally or alternatively include electrical or electromechanical elements. Non-limiting examples of suitable devices that can be employed as sensing element 102 include an electromechanical pressure sensor, an electric eye, or any type of camera.

Stoppage element 104 in the example above is a blocking member which in the first condition 104A physically obstructs lift access means 118 and in the second condition 104B reveals, or does not obstruct, the lift access means 118. While alternation of stoppage element 104 between the first condition 104A and the second condition 104B in this example involves physical movement via mechanical operation, it is to be noted that stoppage element 104 can additionally or alternatively be electromechanical or electrical in operation. Non-limiting examples of suitable devices which can comprise stoppage element 104 include a signaling device that alerts a lift device operator to refrain from freight 116 removal, an element which hides lift access means 118 from view but does not necessarily physically obstruct access to lift access means 118, or any other element configured to impede freight removal.

Similarly, in the example utilized for illustrative purposes here, warning element 106 is a physical sign which alternates by mechanical means between the first state 106A and the second state 106B and the first and second states 106A and 106B differ from one another by physical position of the sign. In different variations, warning element 106 could include an alternative mechanical configuration, an electromechanical device, or an electrical device. Suitable alternatives can also include a sign which mechanically or electromechanically rotates to hide or display an imprinted face in the first and second states, 106A and 106B respectively, one or more lights which alternate between illumination or no illumination or display different colors in the first and second states 106A and 106B, or any other system configured to transmit a warning when in the second state 106B and not to transmit the warning when in the first state 106A.

In the example of FIGS. 4A and 4B, actuator 108 is a foot pedal and engagement of actuator 108 can involve foot pedal depression by a user's foot. Also in the example of FIGS. 4A and 4B actuator 108 is mechanical in operation. In different aspects actuator 108 can be a different type of mechanical device, such as a hand-operated lever or a crank, or can be an electromechanical or electrical device such as a button or a pressure sensor. In some such aspects the operational nature of actuator 108 (mechanical, electromechanical, or electrical) is likely to correspond to the operational nature of stoppage element 104, warning element 106, or both. For example, a warning element 106 which is principally electrical in operation, such as one or more lights which turn on and off or change color in alternating between the first state 106A and the second state 106B would be likely to be in electrical communication with an actuator 108 which is electrical or electromechanical in operation.

In the above referenced drawings, for example FIG. 5A, the apparatus 100 is configured so that stoppage element 104 and warning element 106 are disposed on opposite sides of the apparatus 100 and actuator 108 is disposed on the same side of the apparatus 100 as is warning element 106. While this is likely to be a useful configuration in some circumstances, such a configuration is not essential. The location of various elements like sensing element 102, stoppage element 104, warning element 106, and actuator 108 on or within the apparatus 100 can be altered to maximize suitability with respect to factors such as the shape and size of freight 116 or the relative directions from which freight 116 would be removed and from which a user would access articles.

The foregoing description relates to what are presently considered to be the most practical configurations. It is to be understood, however, that the disclosure is not to be limited to these configurations but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A freight removal regulation apparatus, comprising:

a sensing element operable to determine a presence of freight;

a stoppage element operable to alternate between a first condition configured to impede freight removal and a second condition configured to permit freight removal;

an actuator; and a warning element configured to alternate between a first state allowing user access and a second state warning against user access, wherein the presence of freight maintains the stoppage element in the first condition and maintains the warning element in the first state, absent engagement of the actuator; and wherein engagement of the actuator switches the stoppage element to the second condition and switches the warning element to the second state, when freight is present.

2. The apparatus as recited in claim 1, wherein the stoppage element comprises a blocking member, the blocking member configured to obstruct one or more lift access means on freight when in the first condition and to reveal one or more lift access means on freight when in the second condition.

3. The apparatus as recited in claim 2, wherein the one or more lift access means on freight comprises one or more fork engagement ports.

4. The apparatus as recited in claim 1, wherein the actuator is a mechanical actuator.

5. The apparatus as recited in claim 1, wherein the actuator is a foot pedal.

6. The apparatus as recited in claim 1, wherein the presence of freight switches the stoppage element from the second condition to the first condition.

7. The apparatus as recited in claim 1, wherein the warning element comprises a sign and alternation of the warning element between the first and second states involves mechanical movement of the sign.

8. The apparatus as recited in claim 1, wherein the presence of freight switches the warning element from the second condition to the first condition.

9. The apparatus as recited in claim 1, wherein the stoppage element and the warning element are disposed on opposing sides of the apparatus.

10. The apparatus as recited in claim 9, wherein the actuator is disposed on the side of the apparatus having the warning element.

11. A method to improve freight use, comprising:

placing freight in position with respect to a sensing element, the placement of freight in position causing:

a stoppage element to be present in a first condition, the first condition configured to impede freight removal; and a warning element to be present in a first state, the first state configured to allow user access; and engaging an actuator to:

switch the stoppage element to a second condition, the second condition configured to permit freight removal; and switch the warning element to a second state, the second state configured to warn against user access.

12. The method as recited in claim 11, wherein the stoppage element comprises a blocking member, the blocking member configured to obstruct one or more lift access means on freight when in the first condition and to reveal one or more lift access means on freight when in the second condition.

13. The method as recited in claim 12, wherein the one or more lift access means comprise one or more fork engagement ports.

14. The method as recited in claim 11, wherein the actuator is a mechanical actuator.

15. The method as recited in claim 11, wherein the actuator is a foot pedal.

16. The method as recited in claim 11, wherein the warning element comprises a sign and wherein switching the warning element between the first state and second state involves mechanical movement of the sign.

* * * * *